United States Patent [19]

Smith

[11] 4,289,311

[45] Sep. 15, 1981

[54] GOLF CLUB

[76] Inventor: Harry A. Smith, 8460 Kings Cove Dr., Salt Lake City, Utah 84121

[21] Appl. No.: 73,264

[22] Filed: Sep. 7, 1979

[51] Int. Cl.[3] ..... A63B 53/04

[52] U.S. Cl. ..... 273/167 F; 273/167 G

[58] Field of Search ..... 273/77 R, 80 C, 80.2, 273/162 R, 162 B, 164, 167–175; D21/214, 217–219

[56] References Cited

U.S. PATENT DOCUMENTS

| | | | |
|---|---|---|---|
| D. 91,336 | 1/1934 | Thompson | D21/218 |
| D. 136,005 | 7/1943 | Armstrong | D21/217 |
| D. 174,032 | 2/1955 | Galambossy | D21/219 |
| D. 193,897 | 10/1962 | Vachon | 273/168 X |
| D. 220,844 | 6/1971 | Letters | D21/219 |
| D. 223,031 | 2/1972 | Ernst | D21/219 |
| D. 237,289 | 10/1975 | Calton | 273/164 X |
| D. 245,932 | 9/1977 | Lowry | D21/218 |
| D. 251,310 | 3/1979 | Paulin | D21/219 |
| 1,952,624 | 3/1934 | Inman et al. | 273/168 X |
| 3,567,227 | 3/1971 | Panks | 273/80 C X |
| 3,992,015 | 11/1976 | Benson | 273/80.2 |
| 4,114,886 | 9/1978 | Koch | 273/162 B |
| 4,240,636 | 12/1980 | Swenson | 273/164 X |

*Primary Examiner*—Richard J. Apley
*Attorney, Agent, or Firm*—Lothrop & West

[57] ABSTRACT

A golf club, particularly a putter, has a unitary body including forward and rearward generally triangular and approximately planar panels merging at their apices with an upright socket adapted to receive a club shank. At their intermediate portions the forward and rearward panels are spaced apart, and at their bases the panels merge with the forward and rearward transverse margins of a ground panel substantially square in plan in a plane normal to the socket axis. The upper face of the ground panel has an upstanding, massive hump. One, or preferably both, of the side margins of the ground panel forms a substantially upright impact face.

3 Claims, 5 Drawing Figures

GOLF CLUB

BRIEF SUMMARY OF THE INVENTION

Especially for use in putting in playing golf, there is provided a club having a head with a top central socket symmetrical about an axis. A square, in plan, ground panel is likewise symmetrical about the axis. The socket and ground panel are joined by a forward, generally triangular panel and a rearward, generally triangular panel between them leaving a central open space. Each of the forward and rearward panels at its apex portion merges with the socket and along its base portion merges with the ground panel. There is a hump upstanding from the ground panel in the space between the forward panel and the rearward panel. At least one of the side margins of the ground panel, and preferably both side margins thereof, is finished with a generally upright, planar impact surface.

DETAILED DESCRIPTION

Figure 1:
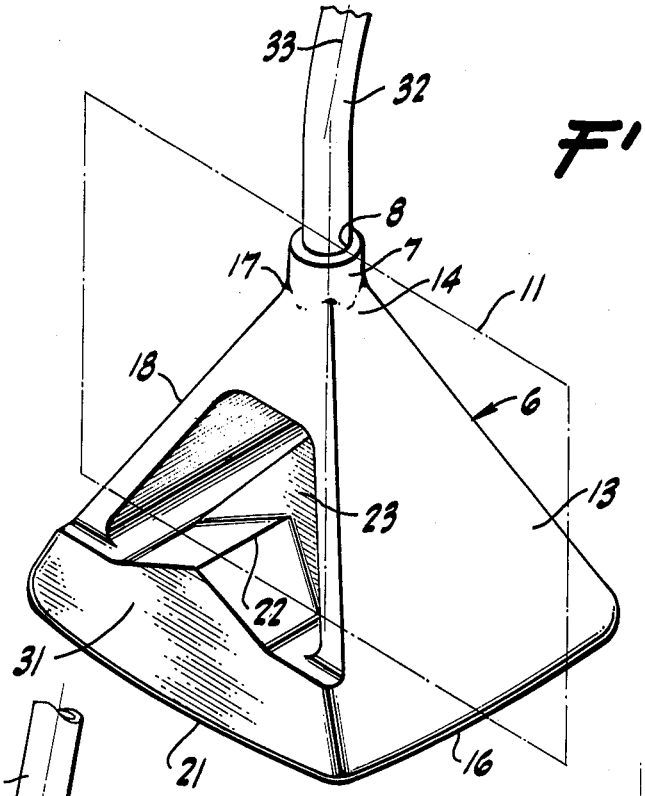
FIG. 1 is an isometric view of a golf club constructed pursuant to the invention, a portion of the club shaft being broken away.
Figure 2:
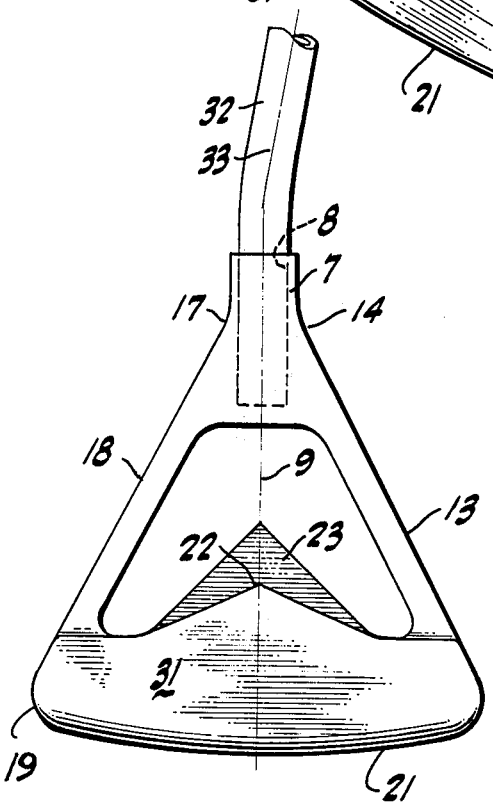
FIG. 2 is a side elevation of the club of FIG. 1.
Figure 3:
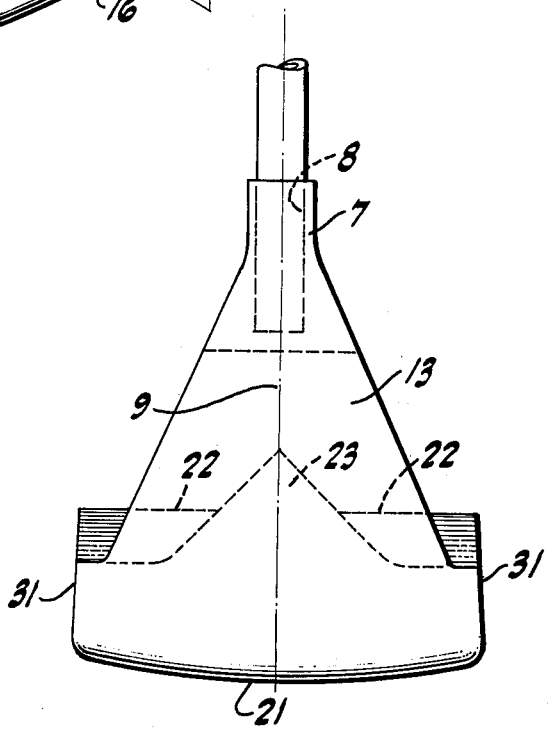
FIG. 3 is a front or rear elevation of the club of FIG. 1.

While the golf club or putter, in accordance with the invention, can be incorporated in a number of different ways, it has with considerable success been incorporated especially as shown in FIGS. 1 through 3 hereof. In this version of the device, there is a unitary body 6, preferably of cast metal or the like, which in its upper portion is formed to afford a socket 7 having a cylindrical depression or hole 8 therein of generally circular configuration and symmetrical about an upright axis 9. Preferably, the axis 9 lies within a plane 11 of symmetry for the golf club.

The material forming the socket 7 merges smoothly in the forward portion with a forward panel 13 generally triangular in aspect and arranged with its apex 14 at or adjacent to the socket and with its base 16 or forward margin normal to the plane 11. Similarly, the socket 7 likewise merges with the apex 17 of a rearward, generally triangular panel 18. The generally triangular rearward panel 18 terminates in its lower portion in a rearward margin 19 normal to the central plane 11. Preferably, both of the panels 13 and 18 are substantially of uniform cross-sectional thickness or are substantially planar and leave an open space between them.

Along their lower margins, both of the panels 13 and 18 merge smoothly with a ground panel 21. This is substantially square in plan and extends in a planar fashion normal to the axis 9, being also equilaterally disposed on opposite sides of the plane 11. The ground panel is at the bottom of the open space and is generally planar throughout much of its extent, although it is preferably somewhat thicker than the forward and rearward panels 13 and 18, respectively. Particularly, the ground panel has a hump 22 upstanding from its upper planar face. The hump may have various configurations. In one instance the hump 22 is primarily a transverse, upstanding ridge spaced from both the forward panel and the rearward panel. The hump may also, in certain instances, be augmented by an upstanding central portion 23 of pyramidal configuration spaced from the forward and rearward panels but affording an additional mass centralized about the axis 9.

In addition, at least one of the side margins of the ground panel and preferably both of them, is provided with an approximately planar surface 31 of upstanding, symmetrical disposition and in position and of sufficient extent to afford an impact surface for a golf ball.

In the use of this device, the club head is joined with a shank 32 engaging the socket 7 and extending for some distance along the axis 9, although usually diverging along an intersecting axis 33 to the customary grip. In use, the club is placed alongside of or close to a golf ball on a green, for example; and the club is swung in the customary fashion. It is immediately felt and noticed that the club is generally symmetrical, that much of the weight of the club is equally distributed about the axis 9 and that the possible striking faces 31 are equidistant from and are parallel to the plane 11, which contains the axis 9. For this reason, the club can be used either as a left-hand or right-hand club and is effective to impose a massive momentum transfer to the ball when the ball is contacted by the adjacent one of the faces 31.

Figure 4:
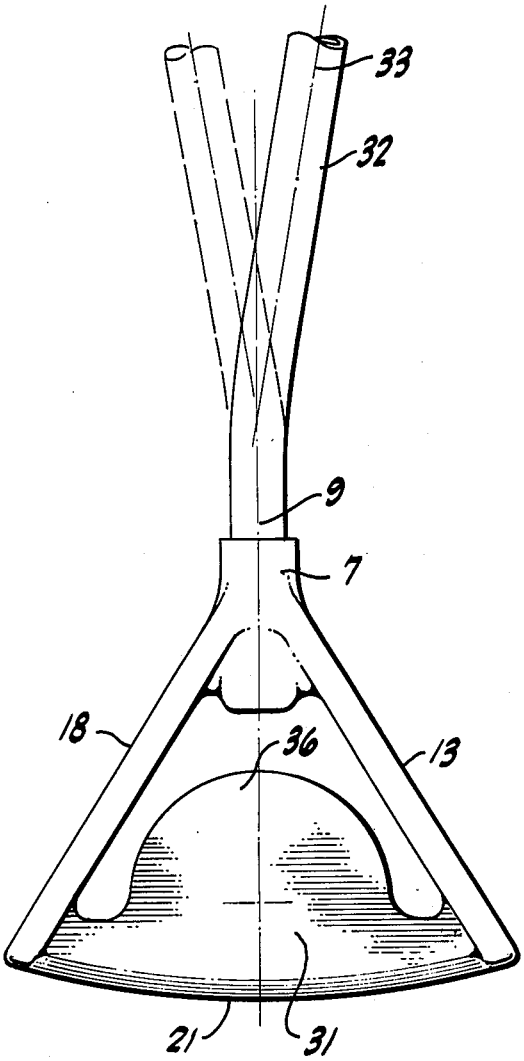
FIG. 4 is a side elevation of a modified form of club.
Figure 5:
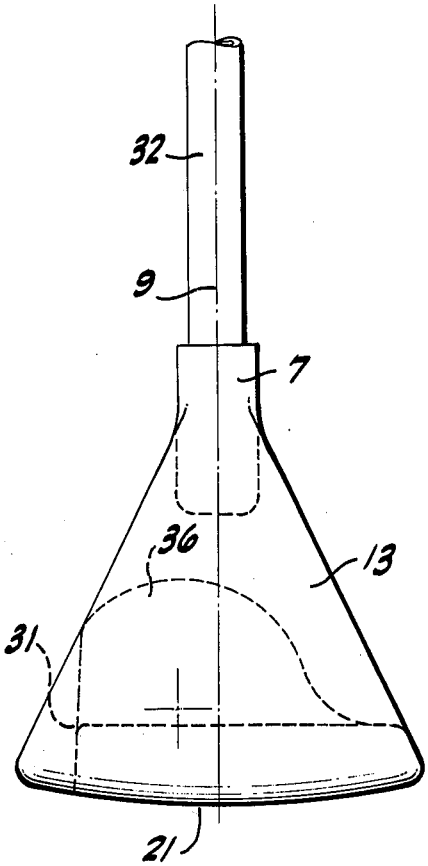
FIG. 5 is a front or rear view of the modified form of club.

As shown particularly in FIGS. 4 and 5, the construction is almost exactly as previously described except that the hump 36, in this instance, is not entirely symmetrical with the axis 9, as it is in the FIG. 1 version, but instead is asymmetrical and is extended to merge with the only or single impact face 31 afforded in this form of club.

I claim:

1. A golf club having a configuration substantially symmetrical on opposite sides of a central vertical plane comprising a unitary body having a lower portion and an upper portion and in said upper portion having a cylindrical socket with a bottom end and with the socket axis vertically disposed in said plane, said body in said lower portion including a ground panel substantially square in outline in a plane normal to said vertical axis, said ground panel having a forward edge margin and a rearward edge margin parallel to each other and normal to said central plane and having a pair of substantially parallel side margins extending parallel to said vertical plane and between said forward edge margin and said rearward edge margin, said ground panel being disposed with the center thereof substantially on said axis and having an upper portion spaced a substantial distance below said socket, said body including a forward solid panel substantially triangular in outline with a forward apex merging with said socket and a forward base merging with said forward edge margin of said ground panel, said body including a rearward solid panel substantially triangular in outline with a rearward apex and a rearward base merging with said socket and said rearward base merging with said rearward edge margin of said ground panel, said forward and rearward panels, said bottom end of said socket and said upper portion of said ground panel being spaced apart to leave an opening between them, and said body including a hump upstanding from at least the central portion of said upper portion of said ground panel between and spaced from said forward panel, said rearward panel and said socket and extending to at least one of said side margins of said ground panel, said hump being normal to said vertical plane and symmetrical about a vertical plane through said axis, and means defining an impact face upstanding from at least one of said side margins of said ground panel substantially midway between said forward panel and said rearward panel.

2. A device as in claim 1 including impact faces upstanding from both of said side margins of said ground panel and symmetrical with each other.

3. A device as in claim 1 in which said forward panel and said rearward panel are both of substantially uniform thickness.

* * * * *